US005243895A

United States Patent [19]

Dickman et al.

[11] Patent Number: 5,243,895

[45] Date of Patent: Sep. 14, 1993

[54] SHOT GUN BARREL LEVELING DEVICE

[76] Inventors: John P. Dickman, 3611 Aquarius Dr., Huntington Beach, Calif. 92649; Billy Houston, 14145 Proctor Ave., Suite 3, City of Industry, Calif. 91746

[21] Appl. No.: 755,739

[22] Filed: Sep. 6, 1991

[51] Int. Cl.[5] ..... F41A 21/26; F41A 21/36

[52] U.S. Cl. ..... 89/14.3; 89/14.05

[58] Field of Search ..... 89/14.05, 14.2, 14.3, 89/14.4

[56] References Cited

U.S. PATENT DOCUMENTS

| | | | |
|---|---|---|---|
| D. 285,238 | 8/1986 | Cellini | 89/14.3 |
| 1,636,357 | 7/1927 | Cutts | 89/14.3 |
| 2,589,738 | 3/1952 | Sedberry | 89/14.3 |
| 3,021,633 | 2/1962 | Beretta | 89/14.3 |
| 3,808,943 | 5/1974 | Kelly | 89/14.3 |
| 4,879,942 | 11/1989 | Cave | 89/14.3 |

*Primary Examiner*—David H. Brown

*Attorney, Agent, or Firm*—Beech & Collins

[57] ABSTRACT

An improved shot gun barrel comprising of a cylinder bar with predetermined slots specifically shaped and positioned along the barrel to reduce muzzle size, recoil and noise.

8 Claims, 1 Drawing Sheet

SHOT GUN BARREL LEVELING DEVICE

FIELD OF THE INVENTION

The instant invention relates to an improved shot gun barrel that has specifically designed and positioned openings in the barrel commonly called ports. The openings direct the hot gases to improve barrel performance.

BACKGROUND OF THE INVENTION

Devices similar to the improved shot gun barrel have been described in previous patents. U.S. Pat. No. 3,808,943 described an approach to redirecting the hot gases to improve rifle and pistol performance and the uses of electrical discharge machining (EDM). The prior art did not specifically address the application to the smooth shot gun barrel. The prior inventions did not provide a self cleaning optimally sized, shaped and positioned port.

SUMMARY OF THE INVENTION

It is the primary object of the present invention to provide a ported shot gun barrel which will substantially reduce recoil and muzzle rise on discharge.

It is another object of the present invention to eliminate in part noise associated with ported or braked muzzles.

Still another object is to safely allow increased firing speed for greater fire power by keeping the gun barrel leveled on target for repetitive shooting.

For further objects and for a better understanding of the invention, reference may be had to the following description when reviewed in connection with the accompanying drawing:

DESCRIPTION OF THE PREFERRED EMBODIMENT

Figure 1:
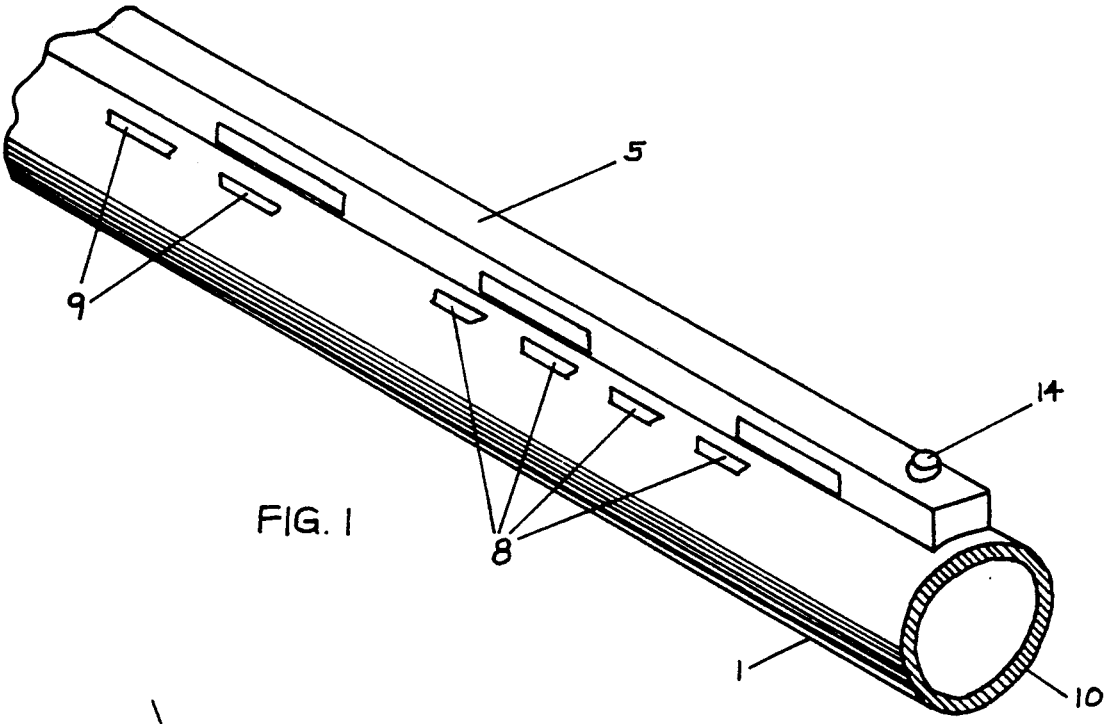
FIG. 1 is an illustrative perspective view of a shot gun barrel embodying the features of the present invention.
Figure 2:
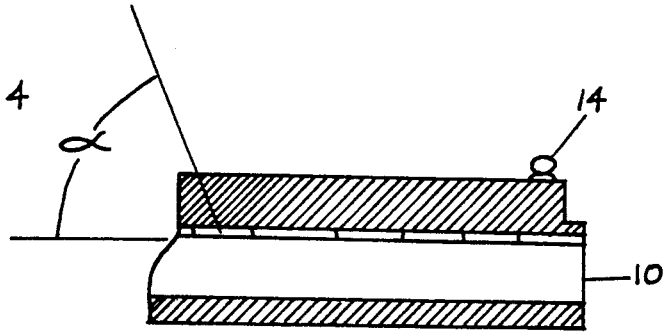
FIG. 2 is a longitudinal cross section taken of the barrel.
Figure 3:
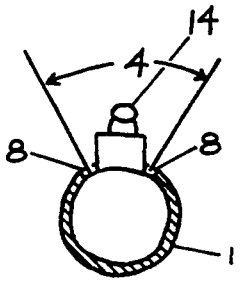
FIG. 3 is a cross section of the barrel.

Referring now to FIGS. 1 to 3, the shot gun barrel (1) including the muzzle (10) and front sight (14) is shown. The shot gun barrel (1) as shown includes a vent rib (5) attached axial along the length of the top of the shot gun barrel (1). Although only one barrel is shown, this positioning can be applied to two barrel shot guns including barrels positioned over and under.

The muzzle end (10) of the barrel (1) is provided at the top with trapezoidal ports (8) having major and minor lengths on either side of the vent rib (5), the muzzle end ports (8), extend through to the bore of the barrel (1) at a compound angle and are symmetrically located on the other side of the barrel (1) positioned on radials between fifteen and twenty-five degrees from the upper centerline of the barrel (1) and of sufficient depth to allow gas in the barrel (1) to escape as the projectiles pass towards the muzzle (10) of the barrel when the gun is being discharged. The fifteen to twenty-five degree angle from the upper centerline is sufficient to assure direction of the gas to be sufficiently vertical to direct the opposing reaction force to counter the tendency of the barrel (1) to rise on discharge.

In operation, after firing of the shot gun, the burning gases expand in the barrel (1) until reaching the initial ports (9) in the barrel (1). A portion of the compressed gases escape as the projectiles pass the initial ports (9) but the projectiles have not yet reached the muzzle ports (8) near the end of the barrel (1). The initial ports (9) and muzzle ports (8) are at the top of the muzzle end of the barrel (1) and cause a force tending to depress the muzzle (10) as the gases escape. The muzzle port (8) nearest the muzzle (10) is sufficiently away from the muzzle (10) to assure sufficient gas expulsion through the initial ports (9) and muzzle ports (8) to assure sufficient force to keep the barrel (1) level on discharge. A distance of at least three inches has been found satisfactory. The sequence of spacing of the initial ports (9) and muzzle ports (8) is to create a prolonged pulse that applies the desired force downward and rearward to the barrel (1). The result of the timed force applied to the end of the barrel (1) is to lower the barrel (1) and countering the normal recoil lifting of the barrel muzzle (10). The rearward projection of the gases causes a forward force component that also reduces the recoil. The forward motion of the exploded gases striking the forward portion of the trapezoidal shaped initial ports (9) and muzzle ports (8) results also in inducing a reaction force directed against the recoil force. The cross-sectional area of the individual initial ports (9) and muzzle ports (8) must be equal to or greater than the area of the bore in order to prevent choking or muzzling of the exploded gases, the choking or muzzling of the exploded gases may result in acceleration of the gases with attendant increase in noise levels. The sequential placement of the initial ports (9) and muzzle ports (8) also serves to reduce the noise. The best results were obtained with a longitudinal sequence of two ports followed by a sequence of four ports paced one fourth an inch apart while the separation between the initial ports (9) and muzzle ports (8) is the space of one missing port. The initial ports (9) located towards the stock end of the shot gun barrel are sufficiently far away as to prevent the gases from being directed at the operator or others nearby. The initial ports (9) and muzzle ports (8) are formed at an angle (4α). The angle (4α) is sufficient to provide the desired results of directing the gases vertically and to the chamber end of the barrel (1). An angle of sixty-eight and one-half degrees has been found to be best. Each port is approximately one fifty-thousandth of an inch wide and shaped as a trapezoid having forty five degree sides. The angle of the individual ports to the chamber end of the barrel (1) create ports that are entirely self-cleaning. The specific placement sequence longitudinally along the barrel (1) when combined with the shape and size provides for each barrel and projectile combination a timed discharge of gas that reduces noise and recoil and allows the shot gun to be used to be redirected more easily when shooting with multiple targets.

Figure 4:
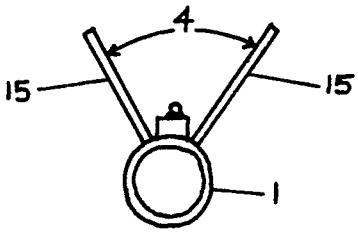
FIG. 4 is an end view of a shot gun barrel with the Electronic Discharge Machine electrodes in place.

One method of assuring properly delivered ports is the use of an Electric Discharge Machine Process. Referring to FIG. 4, the electrodes (15) used in the Electronic Discharge Machine process are shown in position on the barrel (1). The electrodes (15) are connected to a low voltage high amperage source. The shot gun barrel (1) is connected to the opposite pole of the source. The shot gun barrel (1) is submerged in a nonconducting fluid to cool the gun barrel and to rinse away particles. This process is commonly known as electrical discharge machining or ELECTRONIC DISCHARGE MACHINE. The ELECTRONIC DISCHARGE MACHINE process eliminates defects left by other procedures such as milling or drilling and problems related to stressing the barrel.

Tests have indicated that the twenty degree angle, symmetrical horizontal positioning of the slots which collectively equal in area the area of the muzzle bore cross section or are greater than that area and sequential placement substantially reduces noise of the firing and results in up to a 99 percent reduction in muzzle jump and 50 percent reduction in recoil.

I claim:

1. An improved apparatus for reducing muzzle jump of a shot gun having a barrel section having a muzzle end and a chamber end defining a substantially uniform diameter bore through which projectiles travel when driven by expansion of gases comprising a plurality of trapezoidal ports formed into the barrel section and allowing a pressurized gas within the bore to pass to the outside of the barrel and directed upward and rearward, the ports shaped at an angle to the barrel axis to prevent shaving of projectiles passing along the ported barrel and of sufficient number to vent to the atmosphere at least a portion of the gases produced by the discharge of the firearm; the trapezoidal ports further being arranged above an imaginary horizontal plane extending longitudinally of the barrel and lying along the axis of the bore; the trapezoidal ports being of substantially uniform cross-sectional size and shape and terminating at their inner ends in the firearm bore so as to permit the gas venting; the trapezoidal ports further being longitudinally spaced in sets of two where each member of the set is on opposite sides of the top of the barrel in predetermined sequences where the sets are spaced apart by at least the length of the trapezoidal port.

2. The invention as set forth in claim 1 wherein said ports are symetrically oriented at approximately twenty degree angles from an imaginary vertical plane passing through the barrel axis.

3. The invention as set forth in claim 1 wherein the total cross-sectional area of said ports is approximately equal to the cross-sectional area of the bore.

4. The invention as set forth in claim 1 wherein said trapezoidal ports have parallel sides of major and minor lengths, and wherein said major length side of each port is disposed more closely adjacent to a vertical plane than the minor length sides.

5. The invention as set forth in claim 1 wherein said ports are directed toward the chamber end of the barrel at an angle of sixty-eight and one-half degrees.

6. In combination with a firearm barrel having a substantially uniform diameter bore of less than 1" of predetermined cross-sectional area an apparatus for reducing muzzle jump normally produced upon firing projectiles through the bore under the influence of an explosive material said apparatus comprising; a plurality of sets of ports located directly within the barrel and extending between the interior of the barrel and the exterior of the barrel; said ports being generally symmetrically oriented along the horizontal axis of said barrel and terminating at their inner-most ends directly within a portion of the bore which is of the predetermined cross-sectional area and are directed toward the chamber end of the barrel at an angle of sixty-eight and one-half degrees.

7. The invention as set forth in claim 6 wherein said ports are longitudinally spaced in predetermined sequences where the sets are spaced apart by at least the length of the port.

8. The invention as set forth in claim 6 wherein said ports are arranged approximately twenty degrees from an imaginary vertical plane extending through the axis of the bore.

* * * * *